US006364243B1

(12) United States Patent
Baumeister et al.

(10) Patent No.: US 6,364,243 B1
(45) Date of Patent: Apr. 2, 2002

(54) REEL WINDING ARRANGEMENT AND PROCESS

(75) Inventors: Thomas Baumeister, Tönisvorst; Dirk Cramer, Duisburg, both of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/455,325

(22) Filed: Dec. 6, 1999

(30) Foreign Application Priority Data

Dec. 18, 1998 (DE) ..... 198 58 516

(51) Int. Cl.[7] ..... B65H 18/08; B65H 19/30; B65H 67/00

(52) U.S. Cl. ..... 242/533.1; 242/530.4; 242/533.2; 242/533.7

(58) Field of Search ..... 242/530, 530.4, 242/533.1, 533.2, 533.7

(56) References Cited

U.S. PATENT DOCUMENTS

| | | | | |
|---|---|---|---|---|
| 4,508,283 A | | 4/1985 | Beisswanger | |
| 4,951,900 A | * | 8/1990 | Goerner | 242/530.4 X |
| 4,988,052 A | | 1/1991 | Urban | |
| 5,000,395 A | * | 3/1991 | Welp et al. | 242/530.4 |
| 6,089,495 A | * | 7/2000 | Cramer et al. | 242/530.4 |

FOREIGN PATENT DOCUMENTS

| | | | | |
|---|---|---|---|---|
| DE | 3308271 | | 5/1984 | |
| DE | 3243994 | | 7/1986 | |
| DE | 9017555 | | 5/1991 | |
| DE | 29513526 | | 2/1997 | |
| EP | 324709 | | 7/1989 | |
| JP | 2-56346 | * | 2/1990 | 242/533.2 |
| WO | 91/18815 | | 12/1991 | |

* cited by examiner

*Primary Examiner*—Michael R. Mansen
*Assistant Examiner*—Minh-Chau Pham
(74) *Attorney, Agent, or Firm*—Greenblum & Bernstein, P.L.C.

(57) ABSTRACT

A reel winding arrangement includes a contact roller, first and second winding position groups located on a first and second sides of the contact roller, and a core feeding device which includes a longitudinal transport device and a core moving device. The core moving device also includes at least one carrier arrangement positioned to extend over an axial length of said contact roller and at least one pivotable holding arm. A method of winding reel cores includes forming first and second winding positions on first and second sides of a contact roller, loading a plurality of reel cores on a longitudinal transport device, and pivotably feeding the plurality of reel cores from the longitudinal transport device to one of said first winding position and said second winding positions.

48 Claims, 4 Drawing Sheets

REEL WINDING ARRANGEMENT AND PROCESS

CROSS-REFERENCE TO RELATED APPLICATIONS

The present application claims priority under 35 U.S.C. § 119 of German Patent Application No. 198 58 516.0, filed on Dec. 18, 1998, the disclosure of which is expressly incorporated by reference herein in its entirety.

BACKGROUND OF THE INVENTION

1. Field of the Invention

The invention concerns a process and a reel winding arrangement having a plurality of winding positions which are arranged in two winding position groups on two longitudinal sides of a contact roller. The arrangement also includes a core feeding device which incorporates a longitudinal transport device.

2. Discussion of Background Information

Reel winding arrangements are generally known as exemplified from DE 33 08 271 C2, the contents of which are expressly incorporated by reference. The reel cores are typically fed from beneath a contact roller on two transport belts positioned parallel to each other. The position of the individual reel cores relative to their winding position is determined by a stop associated with the respective winding position. Since the individual winding positions of the two winding position groups are arranged with gaps relative to each other, the reel cores cannot be fed jointly, but rather a relatively large expenditure of time is necessary for the correct positioning of the reel cores in the region of the winding position. When the wound reels are completely rolled and a new reel core is to be brought into the winding position, the respective reel core must be repelled laterally from the transport belt. It then arrives on a lift table by which it can be lifted to a height where the respective tensioning spindle of the winding position can grip it.

SUMMARY OF THE INVENTION

The invention simplifies reel core feeding and winding. In particular, the present invention provides a reel winding arrangement and a process which utilizes such an arrangement similar in general to the type mentioned in the introduction. The invention utilizes a core feeding device having a core moving device with two carrier arrangements which run along the axial length of the contact roller and are affixed in each case, to holding arms which are pivotable around the central axis of a contact roller.

With this design, a feeding movement is provided from a pick-up position on a longitudinal transport device to a discharge position on one of two winding position groups, in which the respective reel cores can be engaged by the corresponding tensioning spindles. This movement is performed by the simple pivoting action of a lever on which the carrier arrangements are affixed. With this design, all reel cores of one winding position group can be simultaneously brought from the pickup position on the longitudinal transport device to their discharge position in the region of the tensioning spindles. As a result, only a relatively small structural space is necessary to enable the reel cores to move to their respective winding position group.

Preferably, the longitudinal transport device has a conveyor path for all reel cores of one type, set or size. These cores are positioned serially with their axis running through a vertical plane which is common to the central axis of the contact roller. By this design, the loading of the reel cores into the reel winding device is also greatly simplified. In fact, it is possible to arrange all reel cores of one set, i.e., the reel cores for all winding reels which are to be wound at the same time, end to end and one after another, and to shift them along the transport path into the reel winding arrangement. The longitudinal transport device does not have to be active for this purpose. It may, for example, simply include a channel on which the reel cores can be shifted axially. The individual reel cores, once positioned on the longitudinal transfer device, can then be gripped by the "correct" carrier arrangement, i.e., in alternate fashion with some reel cores being gripped by the carrier arrangement of one winding position group and other reel cores being gripped by the carrier arrangement of the other winding position group. For example, every other reel core is transferred to the same winding position group (either a left side group or a right side group). The result is that none of the reel cores share a same contact surface area of the contact roller. That is, each reel core is staggered on each side of the contact roller. This ensures a positionally correct distribution of the individual reel cores to their respective winding positions and tensioning spindle location. In order to facilitate the transferring of the reel cores, they are positioned with their respective axes sharing the common vertical plane running through the central axis of the contact roller. This design produces a symmetrical arrangement for the winding position groups. Moreover, two lever arms, one for each winding position group, can be utilized for covering the same distance in order to arrive at the discharge position.

Each winding position has at least one pair of tensioning spindles for each reel core, and these spindles are movable in a radial direction on a base relative to the contact roller. Two holding arms are utilized for each winding position group such that they have a discharge position defined by a horizontal axis which is common to the axes of the reel cores, the central axis of the contact roller, and the axes of the tensioning spindles, all of which lie in this one plane. As a result of this configuration, it is possible to handle differently sized reel cores easily. Adapting the arrangement to wind different sizes or diameters of the reel cores is handled simply because the tensioning spindles can be moved radially in relation to the contact roller. In the case of a reel core having a relatively large diameter, the tensioning spindles would simply be moved somewhat farther away from the contact roller in order to be able to engage its respective reel core. This design also utilizes a transport path which is located in the same vertical plane as the central axis of the contact roller. The tensioning spindles can be located, which though horizontally movable, on the same horizontal axis plane which is common to the contact roller. Such a design allows for the lever arms to pivot at an angle of approximately 90°. However, other angular positions may also be utilized depending on where one locates the winding position groups.

Preferably, each carrier arrangement is provided with vacuum type suction heads for gripping the reel cores. These suction heads can hold an outside surface of the reel cores securely with suction. Thus, no failure prone mechanical gripping devices are required on the carrier arrangements. Utilizing these suction heads also allows for the angular positioning of the reel cores to be obtained accurately. Moreover, vacuum holding can be especially useful when the reel cores are provided with an adhesive coating.

Preferably, the suction heads of the two carrier arrangements are positioned with gaps relative to each other, thereby forming a staggered or mesh tooth-like configuration, in the pickup position. With this design, all the reel cores positioned on the longitudinal transport device can be gripped uniformly as they are taken into one or the other winding position group. The predetermined axial positioning of the suction heads on the carrier arrangements also determines which reel core arrives in a particular winding position group. Thus, complicated control measures for subjecting the individual suction heads to suction become superfluous.

In one embodiment, the longitudinal transport device is arranged beneath the contact roller. This design allows the contact roller to be well supported without the risk of sagging, and as a result, the contact roller may be designed with a relatively long axial length.

The longitudinal transport device may also be provided with a height-adjustable receiving surface. As a result, the carrier arrangements need only provide a pure pivot motion. Moreover, this design also allows for the loading of the reel cores into the reel winding arrangement to occur during winding, provided an adequate clearance distance is maintained between the contact roller and the longitudinal transport device. In operation, when the reel cores are ready to be gripped by the suction heads, the receiving surface can be raised to the pick-up position where all the reel cores are easily picked-up by the suction heads.

Preferably, the suction heads can grip the reel cores from directly above the longitudinal transport device, as defined by the vertical plane running through the central axis of the contact roller. This can allow for radial alignment of the reel cores relative to the contact roller, a movement which simplifies the feeding of the reel cores to the tensioning spindles.

In another embodiment, provision may be made for the longitudinal transport device to be arranged above the contact roller. Such a design uses a hinged receiving surface. When the reel cores have been loaded into the longitudinal transport device, the transfer is simplified by tilting a receiving surface down which allows the reel cores to drop onto the core moving device.

It is also possible to align the carrier arrangements in a v-shape formation relative to each other in the pickup position. Such an arrangement provides for suction heads to be aligned at an angle with respect to a vertical axis. This in turn allows the reel cores to be gripped from a position which is from both the side and below the central axis of the reel cores, while at the same time maintaining a tangent contact area which nevertheless remains perpendicular to the central axis of the reel cores. The carrier arrangements thus configured form a sort of trap for the reel cores such that the reel cores can be held in the desired position, i.e., lie with their central axes in the vertical plane which is common to the central axis of the contact roller.

In this embodiment, the receiving surface of the longitudinal transport device is composed of two flaps which can be arranged symmetrically to one another on the two sides of the vertical plane. When released, these flaps can drop or open so that the reel cores are handled symmetrically on both sides of this plane, allowing them to drop along the vertical plane. Thus, no lateral forces are generated when the reel cores drop vertically downwardly. The reel cores may then be gripped by the suction heads for feeding to their respective winding position groups.

According to one aspect of the invention there is a reel winding arrangement which includes a contact roller, first and second winding position groups located on first and second sides of the contact roller, a core feeding device which includes a longitudinal transport device and a core moving device. The core moving device further includes at least one carrier arrangement positioned to extend over an axial length of said contact roller and at least one pivotable holding arm. The arrangement may further provide that the at least one carrier arrangement is adapted to grip a plurality of reel cores positioned on said longitudinal transport device for delivery to one of said first and said second winding position groups. The pivoting axis of the at least one pivoting holding arm may also correspond with a rotational axis of the contact roller. The at least one pivotable holding arm may further include two pivotable holding arms and the at least one carrier arrangement may include two carrier arrangements, and the carrier arrangements are coupled to the two pivotable holding arms.

The arrangement may also include a longitudinal transport device which is positioned along a vertical plane extending axially through the contact roller and the longitudinal transport device such that it is adapted to receive all of the reel cores for a next winding set. The longitudinal transport device may also be arranged below the contact roller. The longitudinal transport device may further be arranged substantially parallel to a rotational axis of the contact roller. Moreover, the longitudinal transport device may be arranged below the contact roller, wherein this position is defined by a vertical plane which passes through the central axis of the contact roller.

The arrangement may also provide that the first and second winding position groups further include at least one pair of tensioning spindles. The at least one pair of tensioning spindles may be radially movable relative to the contact roller on a base. The base may be pivotable between a horizontal winding position and a non-horizontal finish position.

The arrangement may further include a longitudinal transport device which is adapted to receive a plurality of reel cores for use in a next winding set, the at least one carrier arrangement being adapted to pivotably carry the reel cores to a discharge position in which an axis of the reel cores, a rotational axis of said contact roller, and an axis of said tensioning spindles are located in a same plane. Moreover, the discharge position may substantially correspond to a position of a pair of tensioning spindles for engaging the reel cores.

The arrangement may include suction heads for gripping the reel cores on the at least one carrier arrangement. The core feeding device may include first and second pivoting carrier arrangements adapted to grip a plurality of reel cores positioned on said longitudinal transport device for delivery to their respective first and said second winding position groups. These first and second pivoting carrier arrangements may also include respective first and second suction heads for gripping the reel cores. The first and second suction heads may be arranged in a same line which is parallel to the longitudinal transport device. The first and second suction heads may further be respectively arranged on the first and second carrier arrangements such that gaps are formed between adjacent ones of the first suction heads and adjacent ones of the second suction heads, and wherein at least one of the first suction heads is positioned within the gaps between the second suction heads and at least one of the second suction heads is positioned within the gaps between the first suction heads. Moreover, the suction heads can be adapted to grip the reel cores in the longitudinal transport device.

The arrangement may also provide for a longitudinal transport device which includes a reel core lifting surface such that the reel core pick-up position corresponds to a raised position of the reel core lifting surface. The reel core lifting surface can be adjustable between at least a loading position and a raised reel core pick-up position. The longitudinal transport device may also include a reel core lifting surface. Moreover, the longitudinal transport device may also be arranged above the contact roller. The longitudinal transport device may further be arranged above the contact roller, such that this arrangement is defined by a vertical plane which passes through a central axis of the contact roller.

The arrangement may provide that the core moving device includes first and second pivoting carrier arrangements which can grip a plurality of reel cores positioned on the longitudinal transport device for delivery to their respective first and said second winding position groups. These first and second pivoting carrier arrangements can be arranged with one another to form a v-shape configuration and define a reel core pick-up position.

The arrangement may also provide a longitudinal transport device which includes a tiltable receiving surface. This tiltable receiving surface may include two symmetrical flaps which are each arranged on a respective side of a vertical plane running through a central axis of the contact roller.

The invention also provides for a method of winding reel cores which includes forming a first winding position on a first side of a contact roller, forming a second winding position on a second side of said contact roller, loading a plurality of reel cores on a longitudinal transport device, and pivotably feeding the plurality of reel cores from the longitudinal transport device to one of the first winding position and the second winding positions. The pivotable feeding may be performed by a core feeding device which includes at least one pivoting carrier arrangement which can grip said plurality of reel cores. The loading may include placing a plurality of reel cores on a supporting surface such that the plurality of reel cores are arranged end to end. The loading can occur below the contact roller or above the contact roller.

The method may also provide for engaging at least one of the plurality of reel cores with at least one pair of tensioning spindles. The method may also provide for moving at least one of the first and second winding positions prior to engaging. Moreover, the feeding may include a pivoting motion of approximately 90° from the position adjacent the longitudinal transport device to one of the first winding position and the second winding position. This feeding may be performed by first and second pivoting carrier arrangements which can grip a plurality of reel cores positioned on the longitudinal transport device for delivery to their respective first and said second winding position groups. The gripping of the reel cores may be performed with the at least one carrier arrangement prior to feeding. The gripping may be accomplished using suction gripping. And the gripping may be activated when the reel cores are at a reel core pick-up position. Moreover, the gripping may be deactivated after feeding when the reel cores are at one of the first winding position and the second winding position.

The method may also provide for lifting prior to feeding the plurality of reel cores from the loading position to a reel core pick-up position. The gripping of the reel cores may be accomplished when they are positioned at the reel core pick-up position. The method may also provide for lowering prior to feeding the plurality of reel cores from the loading position to a reel core pick-up position. Moreover, the gripping of the reel cores may be accomplished when they are positioned at the reel core pick-up position. Furthermore, the reel core pick-up position may be defined by a v-shape.

In another aspect of the invention, there is provided a reel winding arrangement including a contact roller, a first winding position group located on a first side of the contact roller and comprising at least one pair of tensioning spindles moveably mounted on a first base, a second winding position group located on a second side of the contact roller and comprising at least one pair of tensioning spindles moveably mounted on a second base, a core feeding device comprising a longitudinal transport device and a core moving device, wherein the longitudinal transport device is located on a third side of the contact roller. Moreover, the moving device includes at least one carrier arrangement positioned to extend over an axial length of the contact roller and at least one pivotable holding arm. The carrier arrangement further includes suction heads. The at least one carrier arrangement can grip a plurality of reel cores positioned on the longitudinal transport device for delivery to one of the first and second winding position groups.

In still another aspect of the invention, there is provided a method of winding reel cores which includes forming a first winding position on a first side of a contact roller, with the first winding position having at least one pair of tensioning spindles mounted on a first moveable base, forming a second winding position on a second side of the contact roller, with the second winding position having at least one pair of tensioning spindles mounted on a second moveable base, loading a plurality of reel cores on a longitudinal transport device, with the longitudinal transport device located on a third side of the contact roller, and pivotably feeding the plurality of reel cores from the longitudinal transport device to one of the first winding position and the second winding position. The pivotable feeding is performed by a core feeding device which includes at least one pivoting carrier arrangement which can grip the plurality of reel cores using suction heads.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
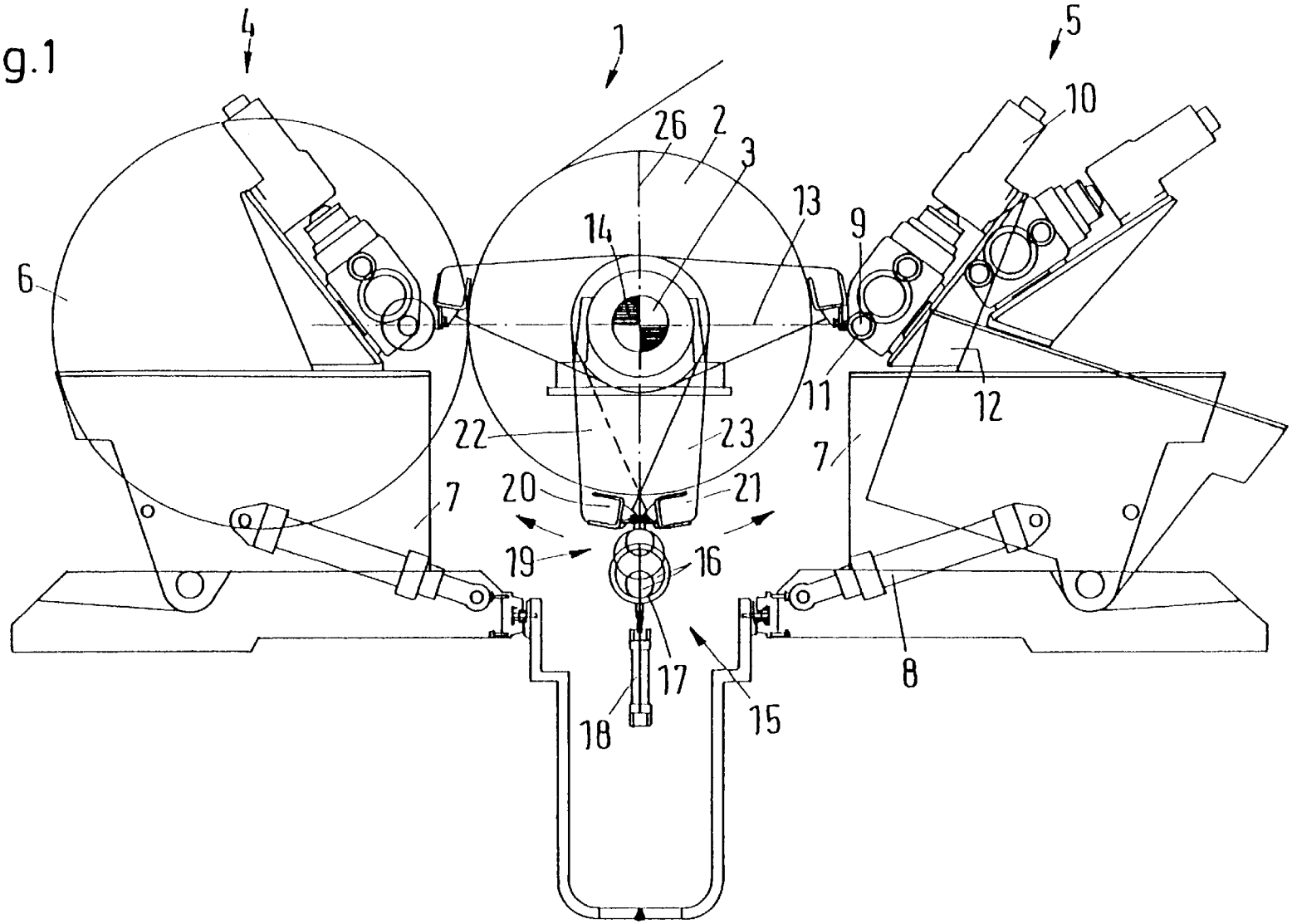
FIG. 1 shows a schematic side view of a reel winding arrangement.

A reel winding arrangement 1 in FIG. 1 has a contact roller 2 driven by a drive 3. A first winding position group 4 is arranged on the left side of contact roller 2 and a second winding position group 5 is arranged on the right side.

In each winding position groups 4, 5, a plurality of winding reels 6 can be wound. Winding reels 6 in winding position 4 are arranged with gaps (not shown) relative to the winding reels in winding position group 5, i.e., the gaps between individual winding reels 6 in winding position group 4 are precisely the same size as the axial length of the respective opposing winding reel in winding position group 5. In other words, winding reels 6 are staggered on both sides of contact roller 2 so that none of winding reels 6 utilize a same contact surface area of contact roller 2.

Two winding brackets 7 are provided for each winding reel. Moreover, each winding bracket can be pivoted by a drive 8, as depicted in winding position group 5. For example, drive 8 is used for tilting winding bracket 7 into a position in which winding reel 6 can be placed on the floor or on a transport device (not shown). A tensioning spindle 9, which can be displaced in a rotational movement by drive 10, is arranged on each winding bracket 7. Tensioning spindle 9 is driven for winding into a reel core 11 and then serves as a central drive. Furthermore, each winding reel 6 is held between brackets 7 such that each tensioning spindle 9 mounted on bracket 7 engages a respective end of winding reel 6.

Tensioning spindle 9, with its drive 10, is affixed to a carrier 12, and this carrier 12 is in turn substantially horizontally moveable with a drive with respect to winding bracket 7. Bracket 7 has a flat surface for this purpose. Winding bracket 7 assumes a basic position for winding and that position is substantially level. As a result of this design, tensioning spindles 9 can move so as to be positioned with their axes on horizontal plane 13, which also corresponds to axis 14 of contact roller 2.

A longitudinal transport device 15 is provided for reel cores 16 and is arranged beneath contact roller 2. Longitudinal transport device 15 has a core channel 17, which is open on at least one end allowing reel cores 16 to be loaded onto channel 17. Channel 17 is also arranged on lifting cylinder 18, which can raise channel 17. To illustrate this, reel cores 16 are depicted at different heights in FIG. 1.

A pickup position 19 for reel cores 16 is located above core channel 17. A core moving device is also utilized which has a carrier arrangement 20, 21, i.e., one for each winding position group 4, 5. Carrier arrangement 20 is affixed to a holding arm 22 and feeds reel cores 16 to winding position group 4. Carrier arrangement 21 is affixed to a holding arm 23 and feeds reel cores 16 to winding position group 5. Thus, each carrier arrangement is used to feed the reel cores 16 from core channel 17 to the respective tensioning spindles 9 of their respective winding position groups 4, 5. Holding arms 22, 23 are also pivotable around central axis 14 of contact roller. These holding arms are arranged in overlapping relationship with holding arm 22 arranged axially in front of the holding arm 23.

Figure 2:
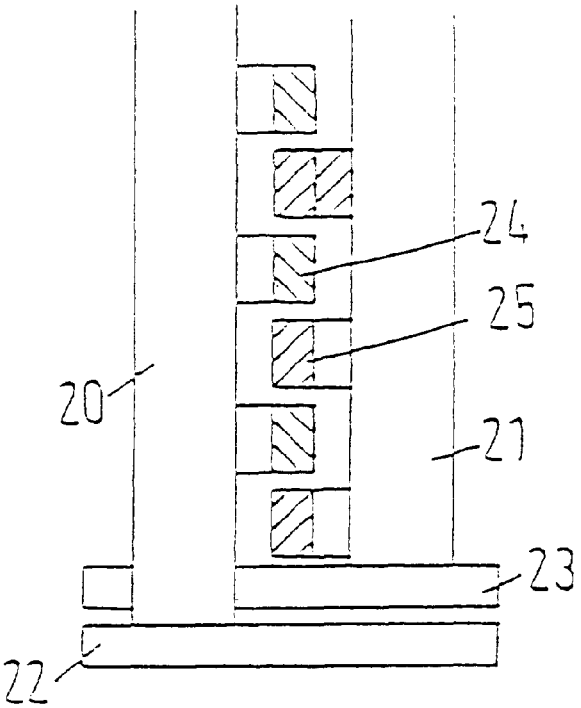
FIG. 2 shows a top view of a carrier arrangement.
Figure 3:
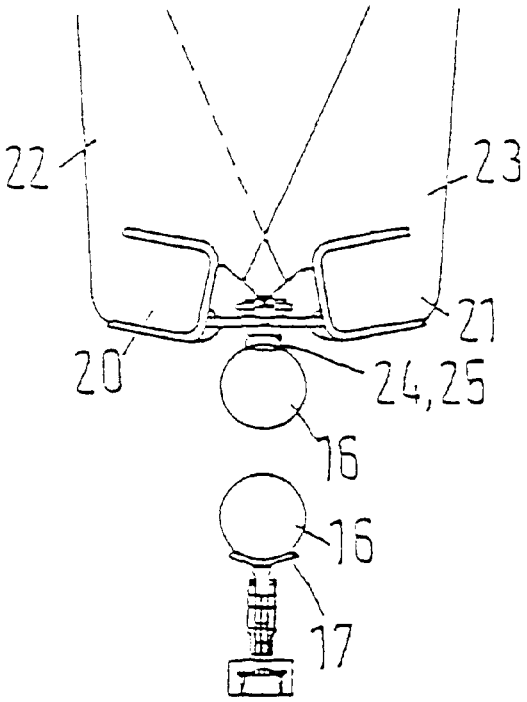
FIG. 3 shows an enlarged side view of the carrier arrangement.

Each holding arm 22, 23 has a group of suction heads 24, 25 which are formed with offset gaps relative to each other and arranged such that they mesh in a tooth-like fashion with one another, in the pickup position 19. This is discernible, for example, in FIG. 2, which shows what suction head 24, 25 look like when viewed looking up from longitudinal transport device 15. With this design, it is possible to arrange all suction heads 24, 25 in one line, one after another, such that this line lies in a vertical plane 26 which is common to central axis 14 of contact roller 2, i.e., the center of the suction heads share the same vertical axis as contact roller when they are in position to grip the reel cores. The central axes of the reel cores 16 also share this axis such that, when core channel 17 is raised by cylinder 18, reel cores 16 are gripped from directly above by the suction heads 24, 25.

Moreover, reel cores 16 can be loaded axially via core channel 17 even when winding reels 6 are still being wound. Once winding is completed a feeding of the new reel cores 16 to the tensioning spindles 9 can be performed. At this point holding arms 22, 23 which should be in a downwardly pivoted position, employ the suction heads 24, 25 which are arranged above core channel 17. Core channel 17 is then raised, followed by actuation of suction heads to apply suction in order to firmly grip the reel cores. All this requires is that suction heads 24, 25 have been previously brought into their proper axial pick-up position, i.e., matched to an axial winding position. To facilitate this, the length of reel cores 16 is selected to correspond to the axial length of winding reel so that all sequential winding positions are occupied. Then, the holding arms 22, 23 are pivoted upwardly by approximately 90° to precisely deliver the reel cores to their respective winding position. Thus, the reel cores are fed to a position at the right height and in the correct axial location to be engaged by tensioning spindles 9. Any differences in the diameter of reel cores 17 can be compensated for by moving carrier 12 on its winding bracket 7. As soon as the reel cores have been engaged by their tensioning spindles, the suction in the suction heads can be eliminated so as to release the reel cores, thereby completing the feeding. The carrier arrangements are then freed so that holding arms can be pivoted downwardly again in order to be in position for gripping the next set of reel cores.

Figure 4:
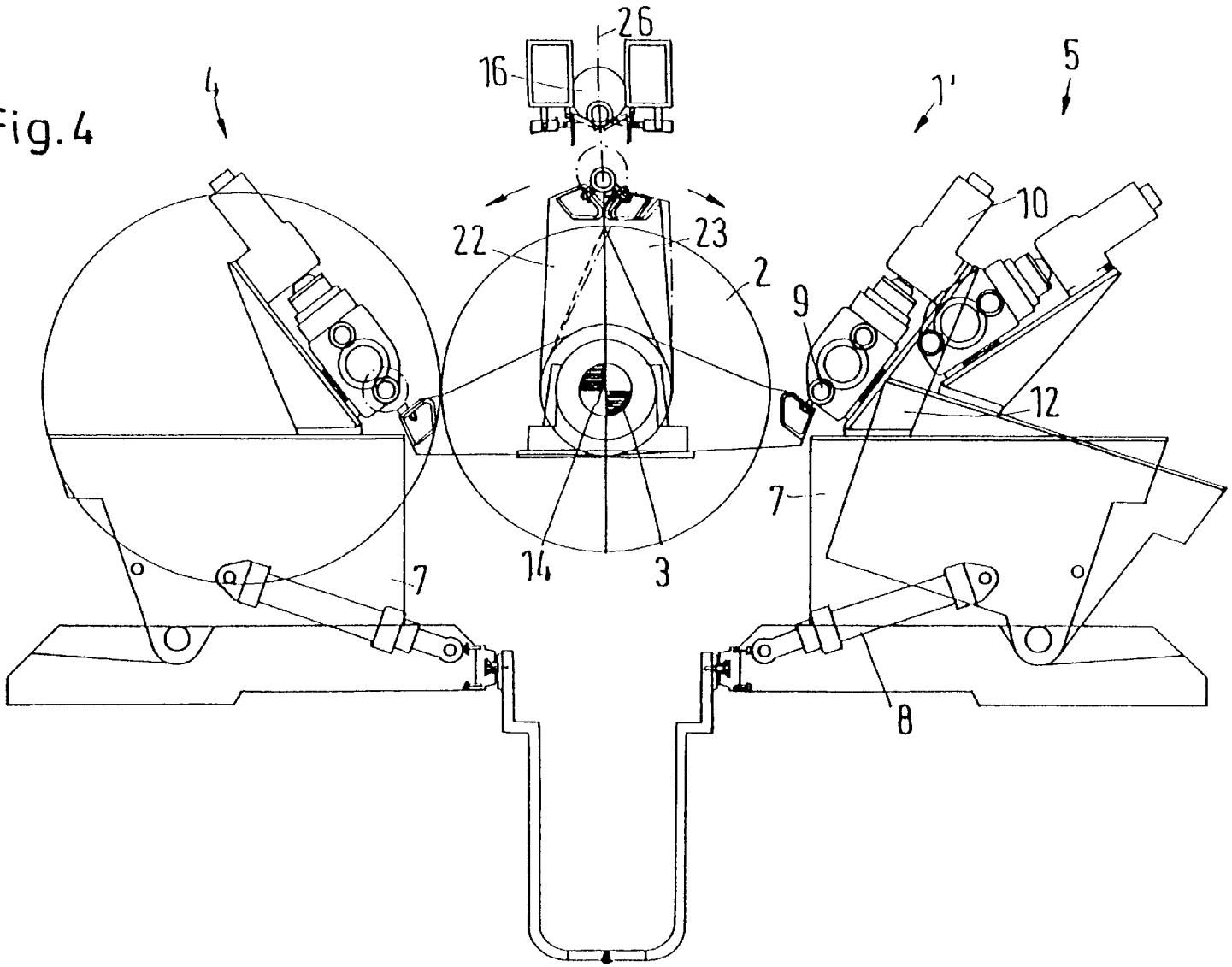
FIG. 4 shows a second embodiment of a reel winding arrangement.
Figure 5:
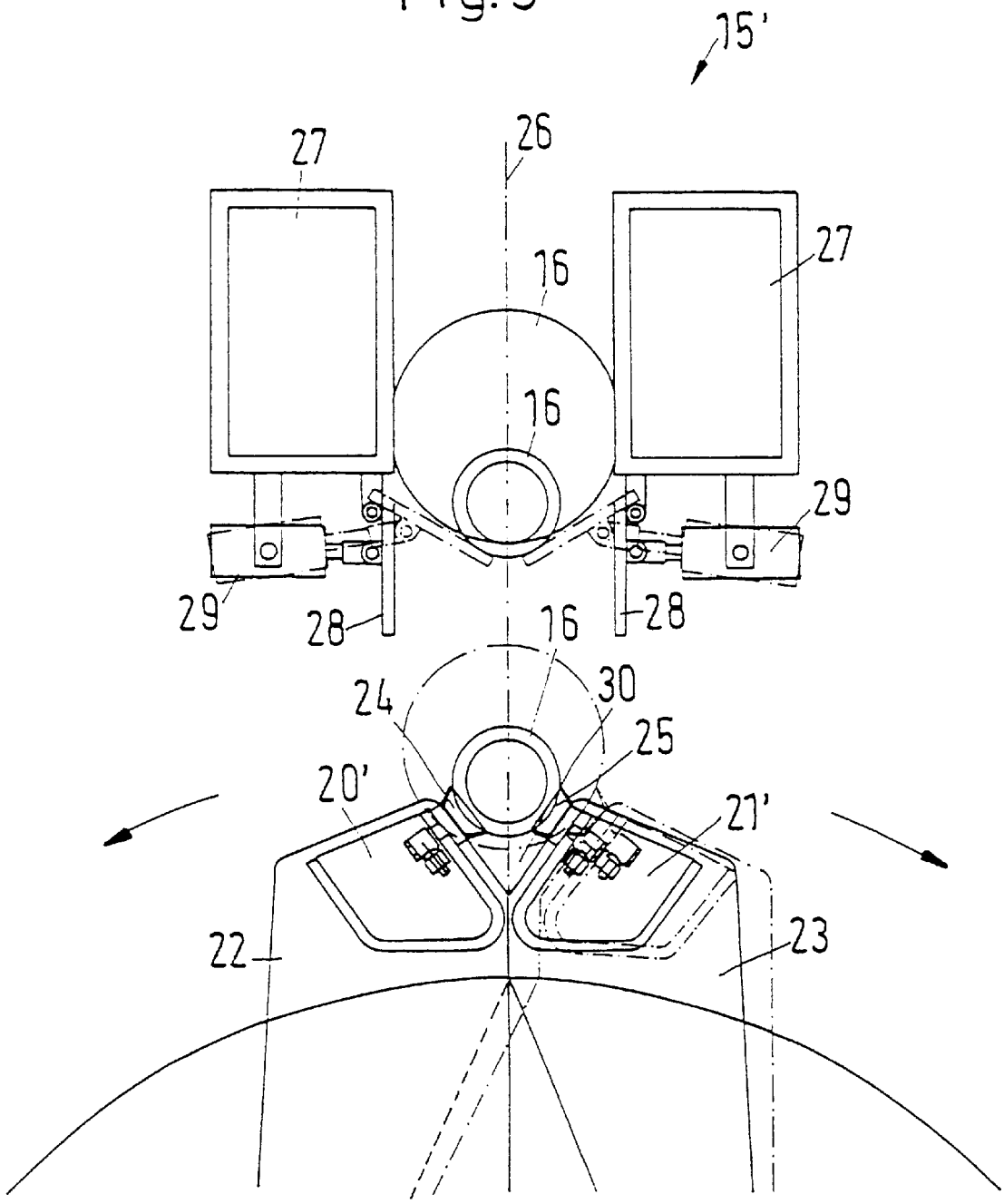
FIG. 5 shows an enlarged detail of FIG. 4.

FIGS. 4 and 5 depict an alternative embodiment of a reel winding arrangement 1' in which identical parts are provided with the same reference characters and corresponding parts with primed reference characters.

In contrast with the embodiment of FIG. 1, the longitudinal transport device is no longer arranged beneath contact roller 2, but is instead arranged directly above it. However, central axis of reel cores 16 continues to lie in the same vertical plane 26 common to central axis 14 of contact roller 2. The longitudinal transport device 15' can be seen enlarged in FIG. 5.

This embodiment utilizes a pair of crossbeams 27 which are arranged equidistant on both sides of vertical plane 26. A flap 28 is hinged to each crossbeam and this flap can be pivoted using a motor 29 from a closed position depicted by dot-dash lines to an open position depicted by solid lines. Although not shown, other types of mechanisms may be utilized to synchronize the movement of the two flaps 28.

Again in this embodiment, holding arms 22, 23 have been pivoted approximately 90° upwardly to form a pick-up position. In this case, carrier arrangements 20', 21' form a V-shaped pickup channel 30, which is likewise arranged symmetrically with respect to vertical plane 26. When flaps 28 are opened, reel cores 16 are allowed to fall downwardly so that they are caught in V-shaped pickup channel 30. As a result, they come to rest on suction heads 24, 25. Then, as an initial step, prior to feeding reel cores 16 into their respective winding position groups 4, 5, the suction heads 24, 25 associated with the respective winding position group, are in each case activated. Thus, with respect to a particular reel core 16, for example, only suction heads 24, associated with the left side or winding position group 4 is activated. The non-activated, respectively opposing suction heads 25 can be used merely to support reel cores 16 until it is held by suction heads 24. The suction head roles are, of course, reversed for the adjacently positioned reel core 16 which lies either in front or behind it in relation to their respective position on the longitudinal transport device.

When all reel cores 16 are firmly held by suction on their respective suction heads, either 24 or 25, arms 22, 23 are pivoted approximately 90° downwardly so as to allow reel cores 16 to be delivered to their respective tensioning spindles 9.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A reel winding arrangement comprising:

a contact roller;

a first winding position group located on a first side of said contact roller;

a second winding position group located on a second side of said contact roller;

a core feeding device comprising a longitudinal transport device and a core moving device; and said core moving device comprising at least one carrier arrangement positioned to extend over an axial length of said contact roller and at least one pivotable holding arm, wherein the at least one pivotable holding arm pivots about an axis of the contact roller.

2. The arrangement of claim 1, wherein said at least one carrier arrangement is adapted to grip a plurality of reel cores positioned on said longitudinal transport device for delivery to one of said first and said second winding position groups.

3. The arrangement of claim 1, wherein said at least one pivotable holding arm comprises two pivotable holding arms and said at least one carrier arrangement comprises two carrier arrangements, and wherein said carrier arrangements are coupled to said two pivotable holding arms.

4. The arrangement of claim 1, wherein said longitudinal transport device is positioned along a vertical plane extending axially through said contact roller and said longitudinal transport device is adapted to receive all of the reel cores for a next winding set.

5. The arrangement of claim 4, wherein said longitudinal transport device is arranged below said contact roller.

6. The arrangement of claim 4, wherein said longitudinal transport device is arranged substantially parallel to a rotational axis of said contact roller.

7. The arrangement of claim 4, wherein said longitudinal transport device is arranged below said contact roller, a position of said longitudinal transport device being defined by a vertical plane which passes through said central axis of said contact roller.

8. The arrangement of claim 1, wherein said first and second winding position groups further comprise at least one pair of tensioning spindles.

9. The arrangement of claim 8, wherein said at least one pair of tensioning spindles are radially movable on a base relative to said contact roller.

10. The arrangement of claim 9, wherein said base is pivotable between a horizontal winding position and a non-horizontal finish position.

11. The arrangement of claim 1, wherein said at least one carrier arrangement comprises suction heads for gripping said reel cores.

12. The arrangement of claim 1, wherein said core feeding device comprises first and second pivoting carrier arrangements adapted to grip a plurality of reel cores positioned on said longitudinal transport device for delivery to their respective said first and said second winding position groups.

13. The arrangement of claim 12, wherein said first and second pivoting carrier arrangements comprise respective first and second suction heads for gripping said reel cores.

14. The arrangement of claim 13, wherein said first and second suction heads are arranged in a same line which is parallel to said longitudinal transport device.

15. The arrangement of claim 14, wherein first and second suction heads are respectively arranged on said first and second carrier arrangements such that gaps are formed between adjacent ones of said first suction heads and adjacent ones of said second suction heads, and wherein at least one of said first suction heads is positioned within said gaps between said second suction heads and at least one of said second suction heads is positioned within said gaps between said first suction heads.

16. The arrangement of claim 15, wherein said suction heads are adapted to grip said reel cores in said longitudinal transport device.

17. The arrangement of claim 16, wherein said longitudinal transport device comprises a reel core lifting surface and a reel core pick-up position corresponds to a raised position of said reel core lifting surface.

18. The arrangement of claim 17, wherein said reel core lifting surface is adjustable between at least a loading position and a raised reel core pick-up position.

19. The arrangement of claim 1, wherein said longitudinal transport device comprises a reel core lifting surface.

20. The arrangement of claim 1, wherein said longitudinal transport device is arranged above said contact roller.

21. The arrangement of claim 20, wherein said longitudinal transport device comprises a tiltable receiving surface.

22. The arrangement of claim 21, wherein said tiltable receiving surface comprises two symmetrical flaps which are each arranged on a respective side of a vertical plane running through the axis of said contact roller.

23. The arrangement of claim 20, wherein said core moving device includes first and second pivoting carrier arrangements which can grip a plurality of reel cores positioned on said longitudinal transport device for delivery to their respective said first and said second winding position groups.

24. The arrangement of claim 23, wherein said first and second pivoting carrier arrangements are arranged with one another to form a v-shape configuration and define a reel core pick-up position.

25. The arrangement of claim 1, wherein said longitudinal transport device is arranged above said contact roller, said arrangement being defined by a vertical plane which passes through the axis of said contact roller.

26. A reel winding arrangement comprising:

a contact roller;

a first winding position group located on a first side of said contact roller;

a second winding position group located on a second side of said contact roller;

a core feeding device comprising a longitudinal transport device and a core moving device; and said core moving device comprising at least one carrier arrangement positioned to extend over an axial length of said contact roller and at least one pivotable holding arm, wherein said first and second winding position groups further comprise at least one pair of tensioning spindles, and wherein said longitudinal transport device is adapted to receive a plurality of reel cores for use in a next winding set, said at least one carrier arrangement is adapted to pivotably carry said reel cores to a discharge position in which an axis of said reel cores, a rotational axis of said contact roller, and an axis of said tensioning spindles are located in a same plane.

27. The arrangement of claim 26, wherein said discharge position substantially defines a position of a pair of tensioning spindles for engaging said reel cores.

28. A method of winding reel cores comprising:

forming a first winding position on a first side of a contact roller;

forming a second winding position on a second side of said contact roller;

loading a plurality of reel cores on a longitudinal transport device; and pivotably feeding said plurality of reel cores from said longitudinal transport device to one of said first winding position and said second winding position, wherein said plurality of reel cores pivot about an axis of the contact roller.

29. The method of claim 28, comprising pivotably feeding with a core feeding device which comprises at least one pivoting carrier arrangement which can grip said plurality of reel cores.

30. The method of claim 28, wherein said loading comprises placing said plurality of reel cores on a supporting surface such that said plurality of reel cores are arranged end to end.

31. The method of claim 28, comprising loading below said contact roller.

32. The method of claim 28, comprising loading above said contact roller.

33. The method of claim 28, further comprising:

engaging at least one of said plurality of reel cores with at least one pair of tensioning spindles.

34. The method of claim 33, further comprising:

moving at least one of said first and second winding positions prior to engaging.

35. The method of claim 28, wherein said feeding comprises a pivoting motion of approximately 90° from said position adjacent said longitudinal transport device to one of said first winding position and said second winding position.

36. The method of claim 35, comprising feeding with a core moving device first and second pivoting carrier arrangements which can grip said plurality of reel cores positioned on said longitudinal transport device for delivery to their respective said first and said second winding position groups.

37. The method of claim 28, further comprising;

gripping said reel cores with said at least one carrier arrangement prior to feeding.

38. The method of claim 37, wherein said gripping comprises suction gripping.

39. The method of claim 38, comprising activating said gripping when said reel cores are at a reel core pick-up position.

40. The method of claim 38, comprising deactivating said gripping after feeding when said reel cores are at one of said first winding position and said second winding position.

41. The method of claim 28, further comprising:

lifting prior to feeding said plurality of reel cores from said loading position to a reel core pick-up position.

42. The method of claim 41, further comprising gripping said reel cores when they are positioned at said reel core pick-up position.

43. The method of claim 28, further comprising:

lowering prior to feeding said plurality of reel cores from said loading position to a reel core pick-up position.

44. The method of claim 43, further comprising gripping said reel cores when they are positioned at said reel core pick-up position.

45. The method of claim 43, comprising feeding with first and second pivoting carrier arrangements which can grip said plurality of reel cores positioned on said longitudinal transport device for delivery to respective first and second winding position groups, wherein said reel core pick-up position is defined by a v-shape configuration between said first and second carrier arrangements.

46. A reel winding arrangement comprising:

a contact roller;

a first winding position group located on a first side of said contact roller and comprising at least one pair of tensioning spindles moveably mounted on a first base;

a second winding position group located on a second side of said contact roller and comprising at least one pair of tensioning spindles moveably mounted on a second base;

a core feeding device comprising a longitudinal transport device and a core moving device;

said longitudinal transport device located on a third side of said contact roller;

said moving device comprising at least one carrier arrangement positioned to extend over an axial length of said contact roller and at least one pivotable holding arm;

said carrier arrangement further comprising suction heads, wherein said at least one carrier arrangement is adapted to grip a plurality of reel cores positioned on said longitudinal transport device for delivery to one of said first and said second winding position groups, and further comprising at least one of:

the at least one pivotable holding arm pivoting about an axis of the contact roller; and said suction heads of the at least one carrier arrangement having offset gaps adapted to mesh in a tooth-like fashion with other suction heads.

47. A method of winding reel cores comprising:

forming a first winding position on a first side of a contact roller, said first winding position having at least one pair of tensioning spindles mounted on a first moveable base;

forming a second winding position on a second side of said contact roller, said second winding position having at least one pair of tensioning spindles mounted on a second moveable base;

loading a plurality of reel cores on a longitudinal transport device, said longitudinal transport device located on a third side of said contact roller; and pivotably feeding said plurality of reel cores from said longitudinal transport device to one of said first winding position and said second winding position, wherein said pivotable feeding is performed by a core feeding device which comprises at least one pivoting carrier arrangement which can grip said plurality of reel cores using suction heads, and at least one of:

said plurality of reel cores pivoting about an axis of the contact roller; and said suction heads of the at least one pivoting carrier arrangement having offset gaps adapted to mesh with other suction heads.

48. A reel winding arrangement comprising:

a contact roller;

a first winding position group located on a first side of said contact roller;

a second winding position group located on a second side of said contact roller;

a core feeding device comprising a longitudinal transport device and a core moving device; and said core moving device comprising at least one carrier arrangement positioned to extend over an axial length of said contact roller and at least one pivotable holding arm;

said core feeding device comprising first and second pivoting carrier arrangements adapted to grip a plurality of reel cores positioned on said longitudinal transport device for delivery to their respective said first and said second winding position groups; and first and second suction heads being respectively arranged on said first and second carrier arrangements such that gaps are formed between adjacent ones of said first suction heads and adjacent ones of said second suction heads, wherein at least one of said first suction heads is positioned within said gaps between said second suction heads and at least one of said second suction heads is positioned within said gaps between said first suction heads.

* * * * *